United States Patent [19]

Gilbreath, Jr. et al.

[11] 4,152,545

[45] May 1, 1979

[54] PULSE POSITION MODULATION SECRET COMMUNICATION SYSTEM

[75] Inventors: Roy E. Gilbreath, Jr., Seminole County; Macdonald J. Wiggins; Kampbell T. Larson, both of Orange County, all of Fla.

[73] Assignee: Martin Marietta Corporation, Orlando, Fla.

[21] Appl. No.: 447,607

[22] Filed: Apr. 5, 1965

[51] Int. Cl.[2] ..... H04K 1/00

[52] U.S. Cl. ..... 179/1.5 R; 179/15 AP; 325/142; 325/143; 325/34

[58] Field of Search ..... 179/1.5, 15 AC, 15 AB, 179/1.5 R, 15 AP; 332/1, 9, 11; 328/109, 119; 329/107; 325/32, 40, 142, 143, 34; 340/345, 349, 347

[56] References Cited

U.S. PATENT DOCUMENTS

| | | | |
|---|---|---|---|
| 3,104,360 | 9/1963 | Lair | 332/1 |
| 3,244,808 | 4/1966 | Roberts | 178/6.8 X |

*Primary Examiner*—Howard A. Birmiel

*Attorney, Agent, or Firm*—Julian C. Renfro; Gay Chin

[57] ABSTRACT

This invention relates to method and apparatus in accordance with which a PPM signal can be encrypted with minimum complexity, involving converting the PPM signal to an encrypted PCM signal, and converting the encrypted PCM signal to a corresponding PPM signal. Only a receiver with a decrypter employing the same modifying code may convert the encrypted PPM to the original PPM intelligence signal.

18 Claims, 9 Drawing Figures

INVENTORS
ROY E. GILBREATH JR.
MACDONALD J. WIGGINS
KAMPBELL T. LARSON

BY Julian T. Renfro
ATTORNEY

INVENTORS
ROY E. GILBREATH JR.
MACDONALD J. WIGGINS
KAMPBELL T. LARSON
BY Julian T. Renfro
ATTORNEY

INVENTORS
ROY E. GILBREATH JR.
MACDONALD J. WIGGINS
BY KAMPBELL T. LARSON

Julian T. Denfro
ATTOR

INVENTORS
ROY E. GILBREATH JR.
MACDONALD J. WIGGINS
BY KAMPBELL T. LARSON

Julian C. Renfro ATTOR.

INVENTORS
ROY E. GILBREATH JR.
MACDONALD J. WIGGINS
KAMPBELL T. LARSON

BY Julian C. Renfro
ATTORNEY

INVENTORS
ROY E. GILBREATH JR.
MACDONALD J. WIGGINS
KAMPBELL T. LARSON

BY Julian L. Penfro
ATTORNEY

INVENTORS
ROY E. GILBREATH JR.
MACDONALD J. WIGGINS
KAMPBELL T. LARSON

BY Julian C. Renfro
ATTORNEY

INVENTORS
ROY E. GILBREATH JR.
MACDONALD J. WIGGINS
KAMPBELL T. LARSON
BY Julian C. Denfro
ATTORNEY

PULSE POSITION MODULATION SECRET COMMUNICATION SYSTEM

This invention relates generally to secret communication systems and more particularly, to a method and system in which intelligence in the form of position modulated pulses is converted into an encrypted form of position modulated pulses prior to transmission.

There are in existence secret pulse communication systems which employ the broad technique of modifying the pulse modulation in such a way that only authorized persons can detect the original modulating intelligence. However, none of these systems is known to be capable of encoding pulse position modulated (PPM) intelligence to provide an encrypted form of PPM signal which is transmitted and received in that form.

Therefore, the principal object of this invention is to provide a method of converting intelligence in the form of PPM pulses to an encrypted form of intelligence-bearing PPM pulses.

Another object of this invention is to provide a method of encrypting intelligence by converting a PPM intelligence-bearing pulse train to a pulse code modulated (PCM) pulse train, encrypting the PCM pulse train, and converting the encrypted PCM pulse train into a corresponding PPM pulse train which may then be transmitted.

A further object is to provide such a method wherein the transmitted PPM pulse train is an encrypted quantized pulse position modulated pulse (QPPM) train.

Still another object is to provide a secret communication system wherein intelligence in the form of PPM pulses is operated upon to produce an encrypted form of intelligence-bearing PPM pulses.

Another object is to provide encoding apparatus for encrypting intelligence-bearing PPM pulses in accordance with the foregoing objects.

Another object is to provide decoding apparatus for decrypting the PPM pulses encrypted in accordance with the foregoing objects.

A more specific object of this invention is to provide a method and means of encrypting PPM pulses by converting a PPM pulse train into a PCM pulse train, adding a predetermined code to the PCM pulse train, and converting the encrypted PCM pulse train to a QPPM pulse train.

These and other objects and advantages of the invention will become apparent from the following description and attached drawings which disclose in detail preferred and other embodiments of the invention.

Figure 1:
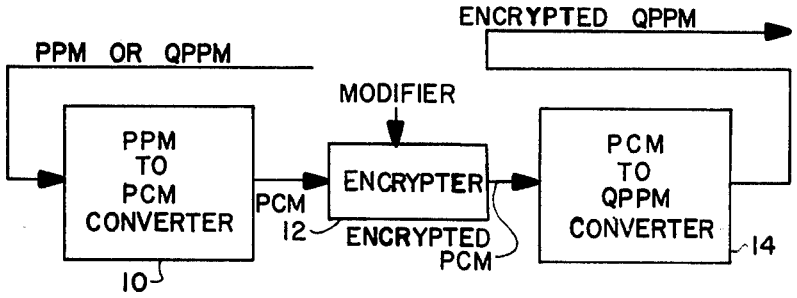
FIG. 1 is a block diagram illustrating the basic concept of this invention.
Figure 4A:
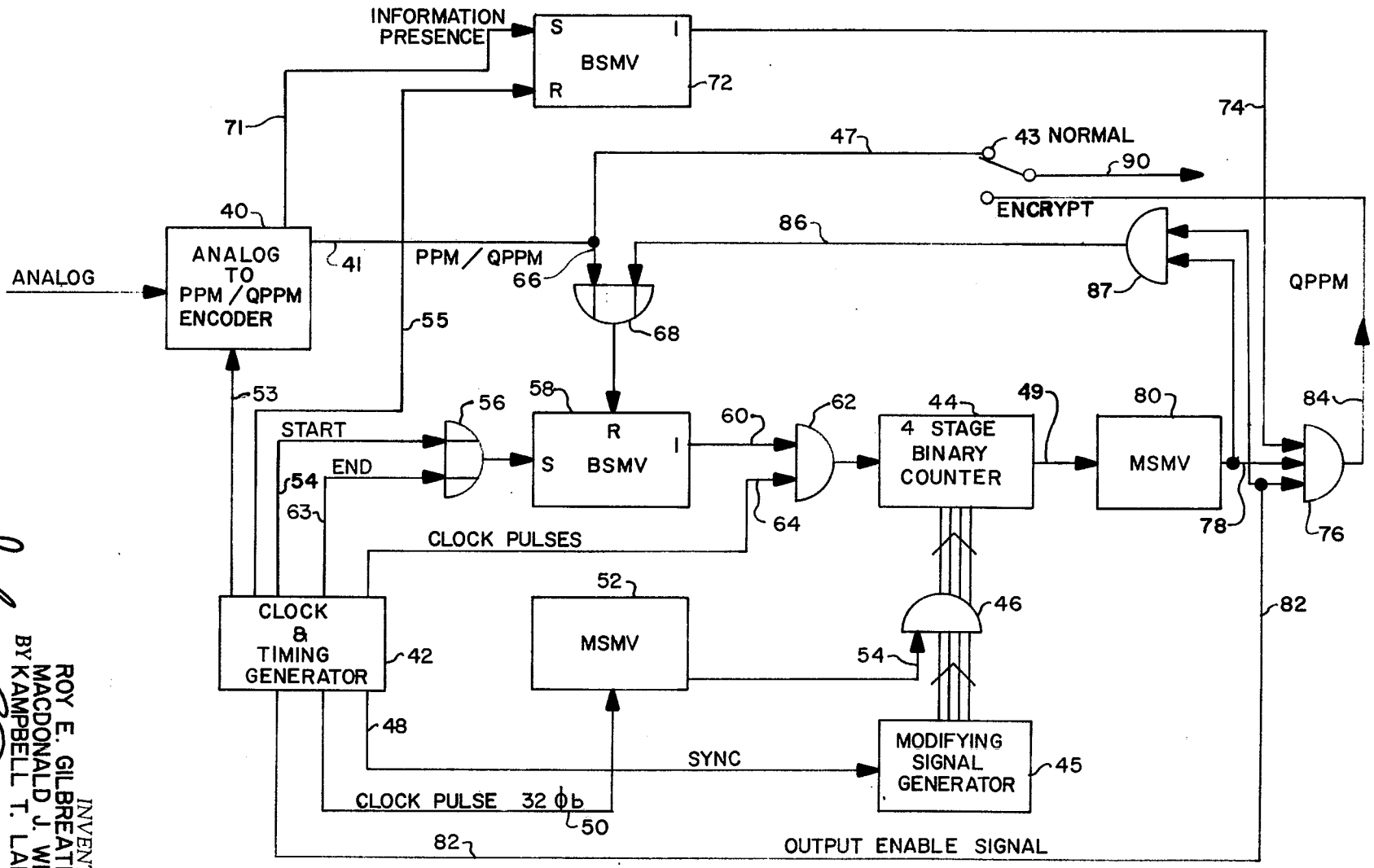
Figure 4B:
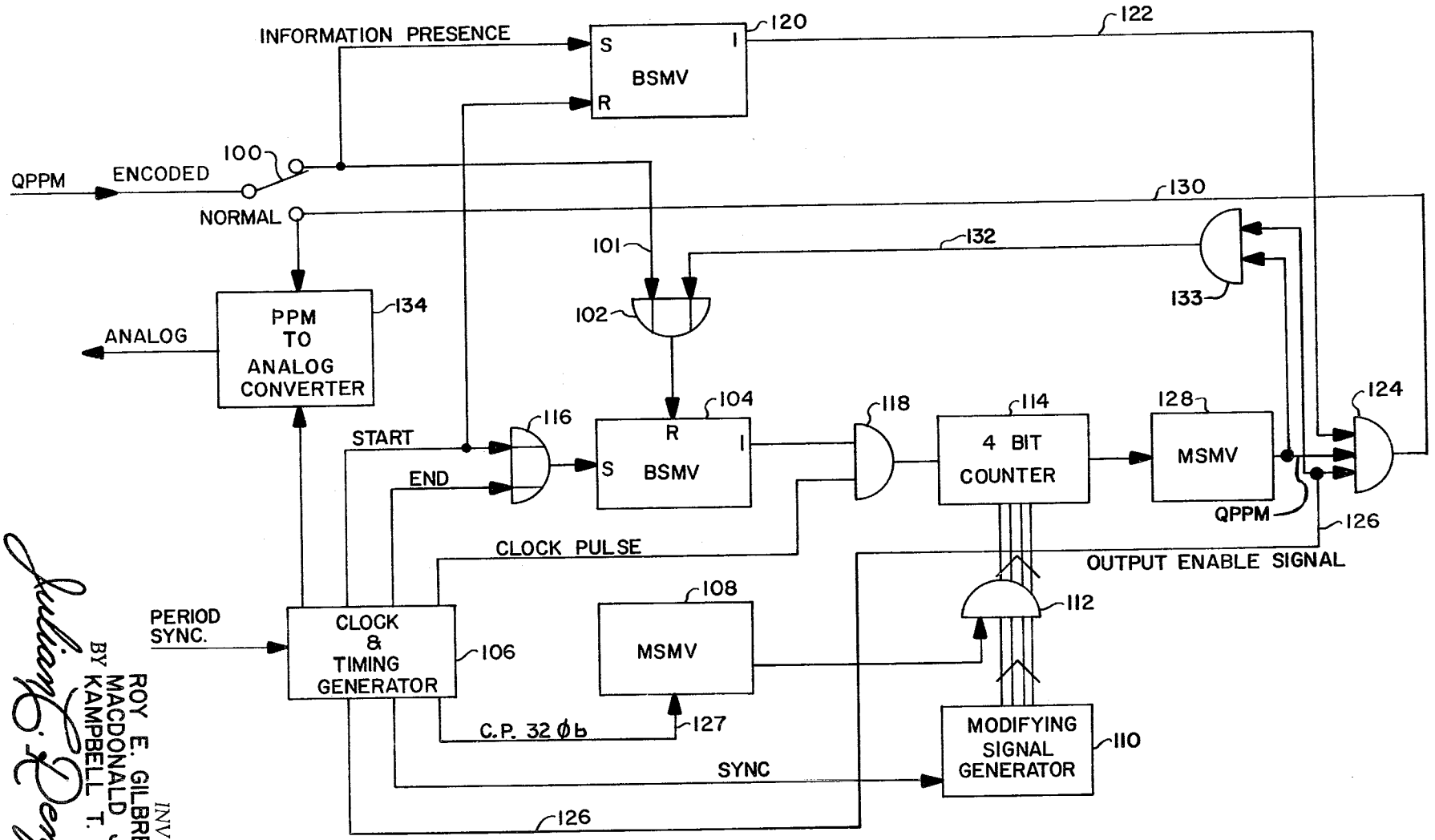

FIG. 4*a* is a block diagram of a preferred embodiment of an encrypting apparatus employing the encrypting method illustrated in FIG. 1;

FIG. 4*b* is a block diagram of a preferred embodiment of a decrypter for use in conjunction with the encrypter of FIG. 4*a;*

Figure 5:
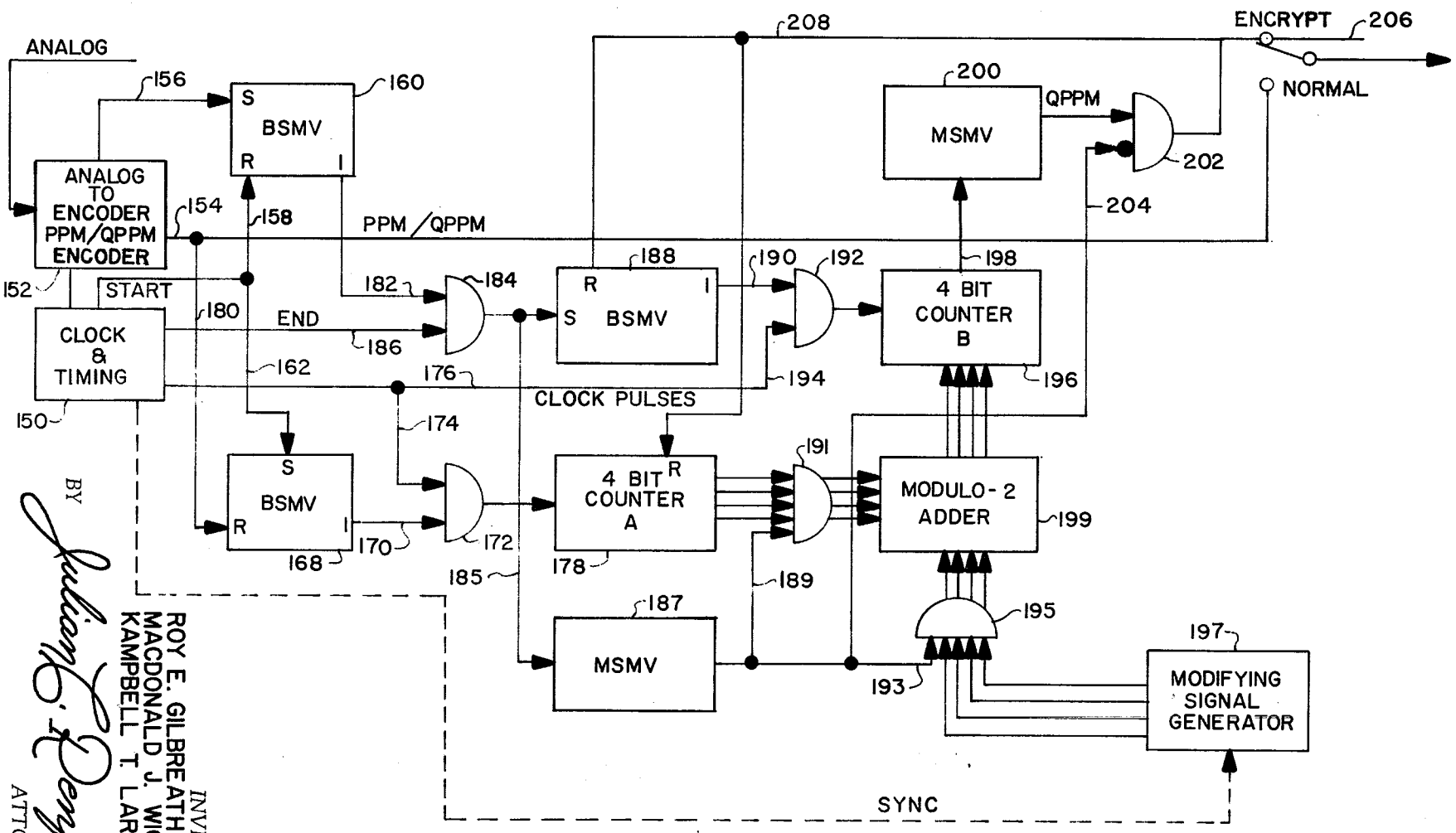
Figure 6:
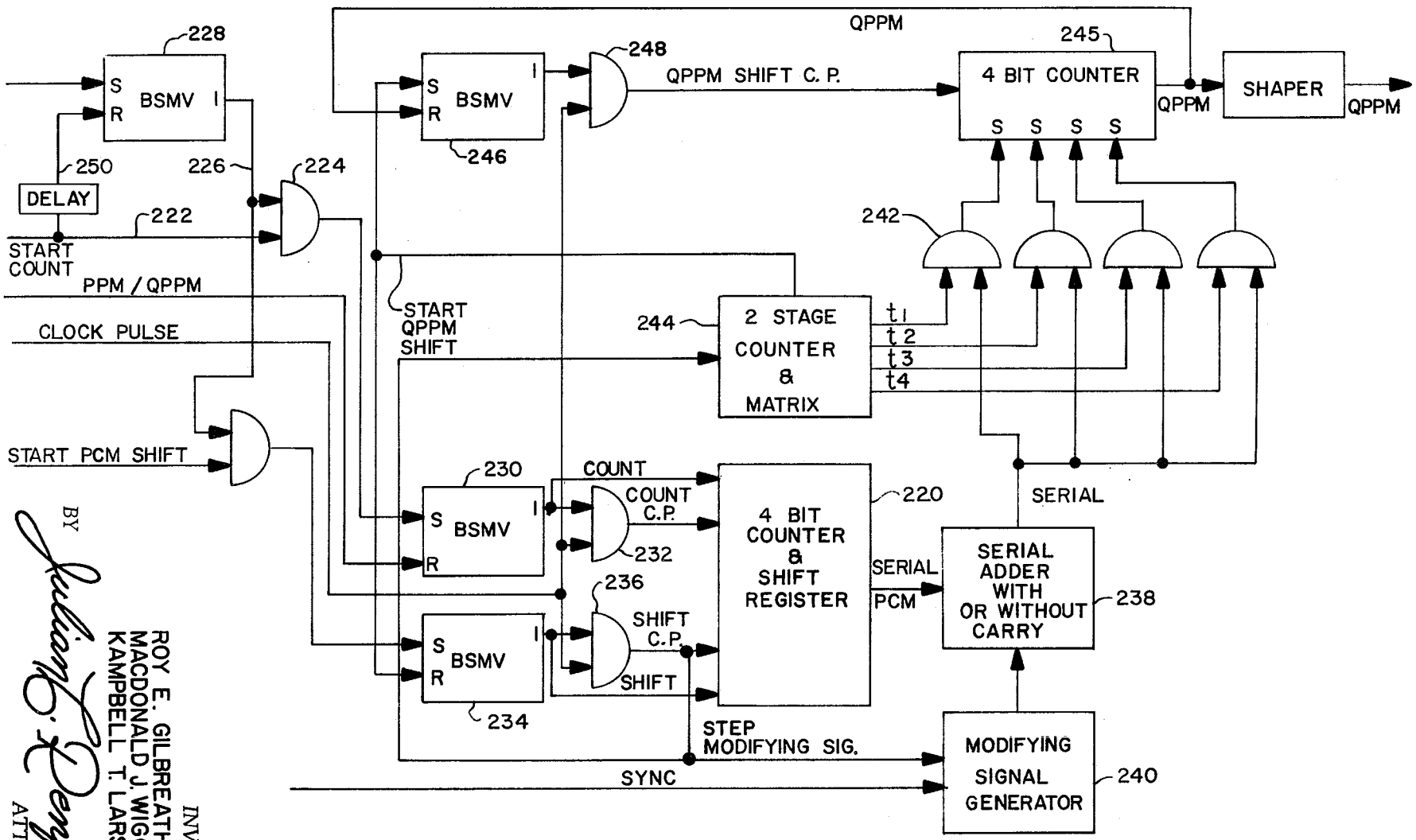
Figure 7:
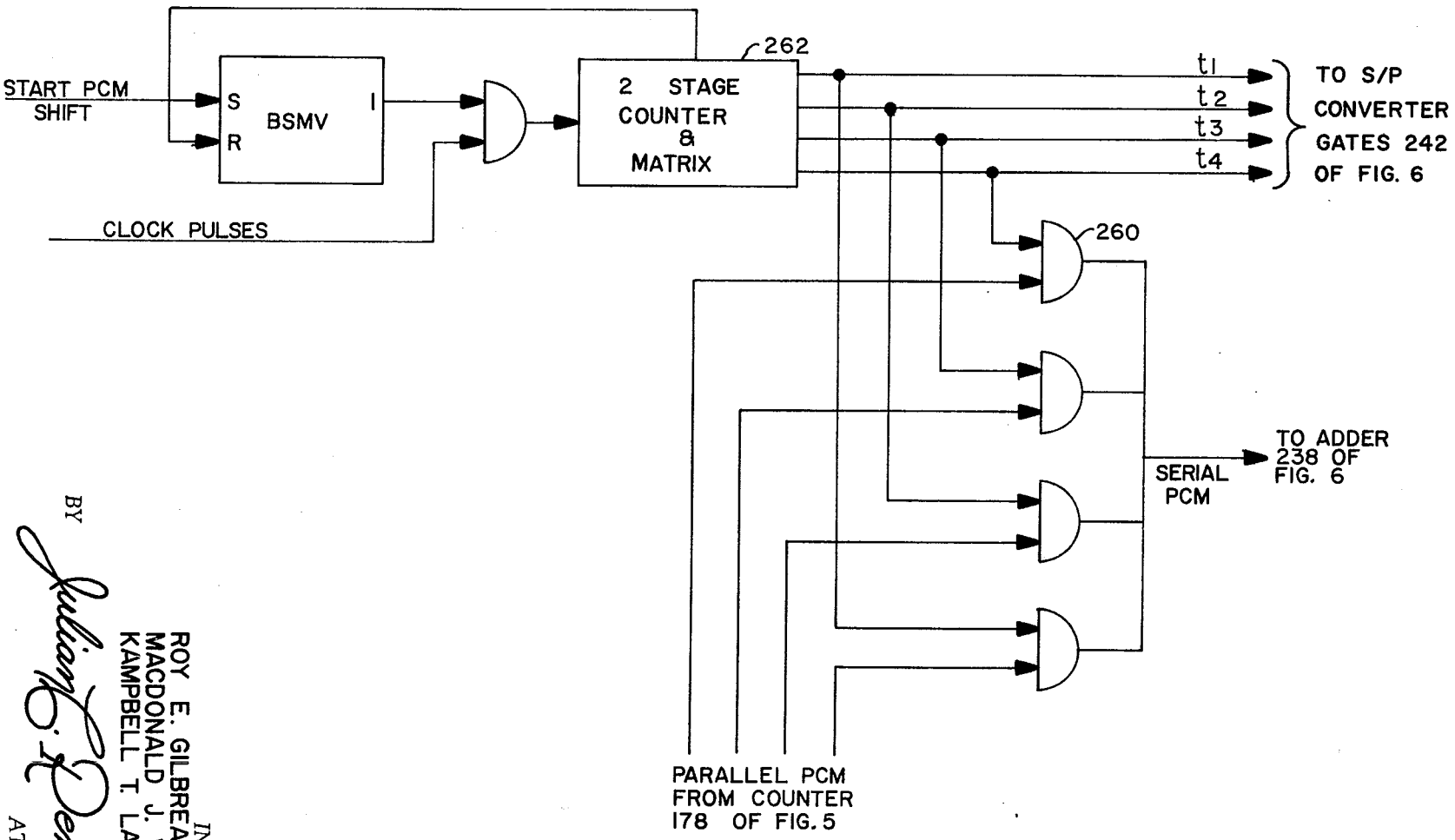
Figure 8:
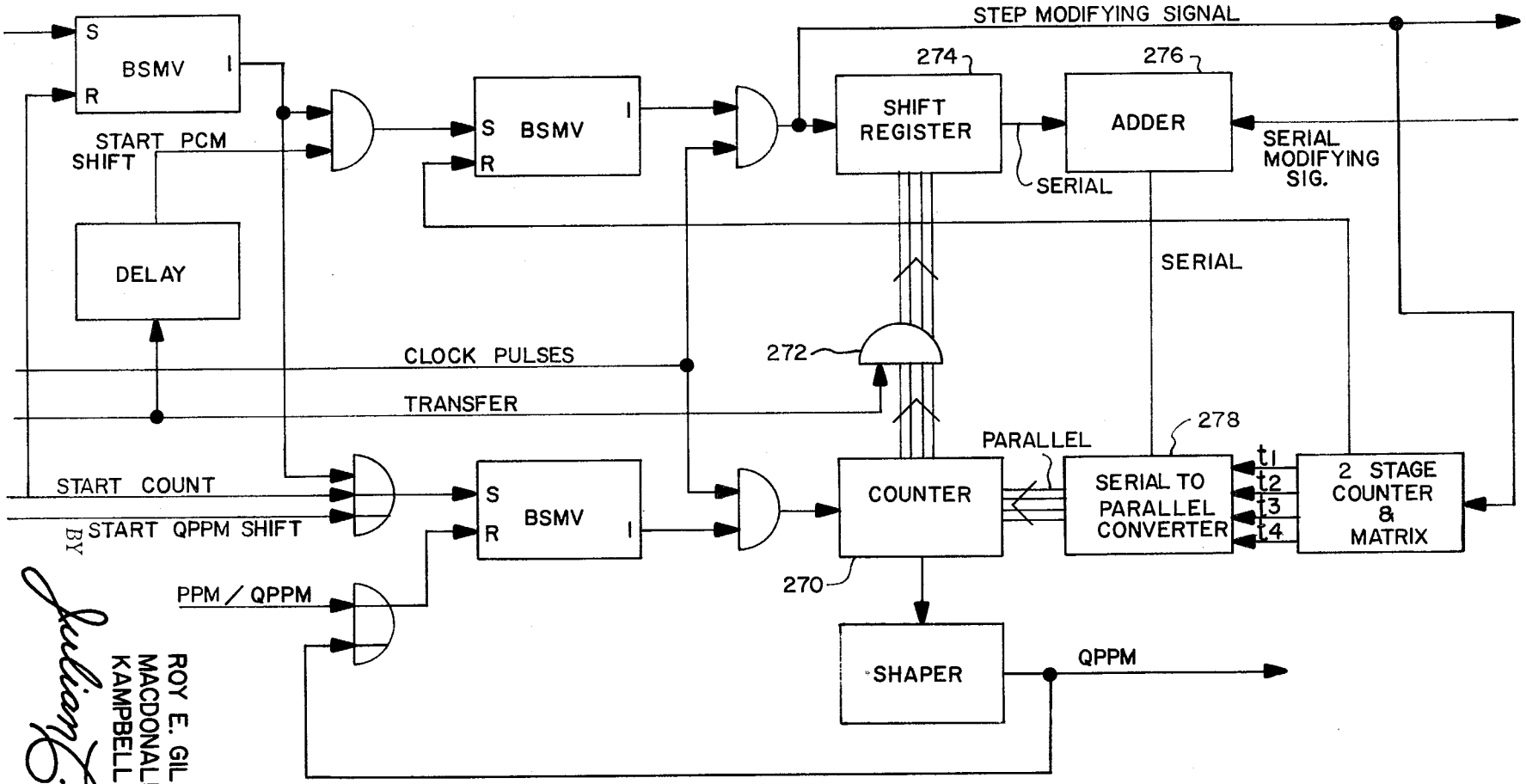

FIG. 5 is a modification of the preferred embodiment shown in FIG. 4*a* and employs modulo 2 addition; and FIGS. 6–8 are block diagrams showing modified forms of the preferred embodiment wherein the encrypting is accomplished in serial mode rather than in parallel mode.

FIG. 1 illustrates the basic inventive concept which is incorporated in a preferred embodiment of the invention as illustrated in more detail in FIGS. 4*a* and 4*b* and also in the other embodiments illustrated in FIGS. 5–8.

an intelligence-carrying pulse position modulated (PPM) or quantized pulse position modulated (QPPM) signal is applied to a converter 10 which converts the position modulated pulses to a pulse code modulated (PCM) signal. This PCM signal and a modifying code are fed to an encrypter 12 which produces at its output a modified or encrypted PCM signal which is then fed to a converter 14 and converted to a corresponding encrypted QPPM signal which may then be transmitted. Only an authorized receiver with a decrypter employing the same modifying code may detect the encrypted QPPM to reconvert it to the original PPM intelligence signal which was applied to converter 10.

Before proceeding to a discussion of the preferred and other embodiments, it will be helpful to present a generalized discussion of the pulse conversion techniques employed in those embodiments and also to define the terms to be used in the later discussion. For this discussion, reference is made to FIG. 2, which is a block diagram of the system and which omits some of the details of the preferred embodiments of FIG. 4*a,* but which is useful for explaining in more detail the basic inventive concept as applied to a secret communication system. Reference will also be made to the timing diagram of FIG. 3, which aids not only in the explanation of the operation of the system shown in FIG. 2, but also illustrates the basic PPM-to-PCM-to-QPPM steps involved in all embodiments of the invention.

Figure 2:
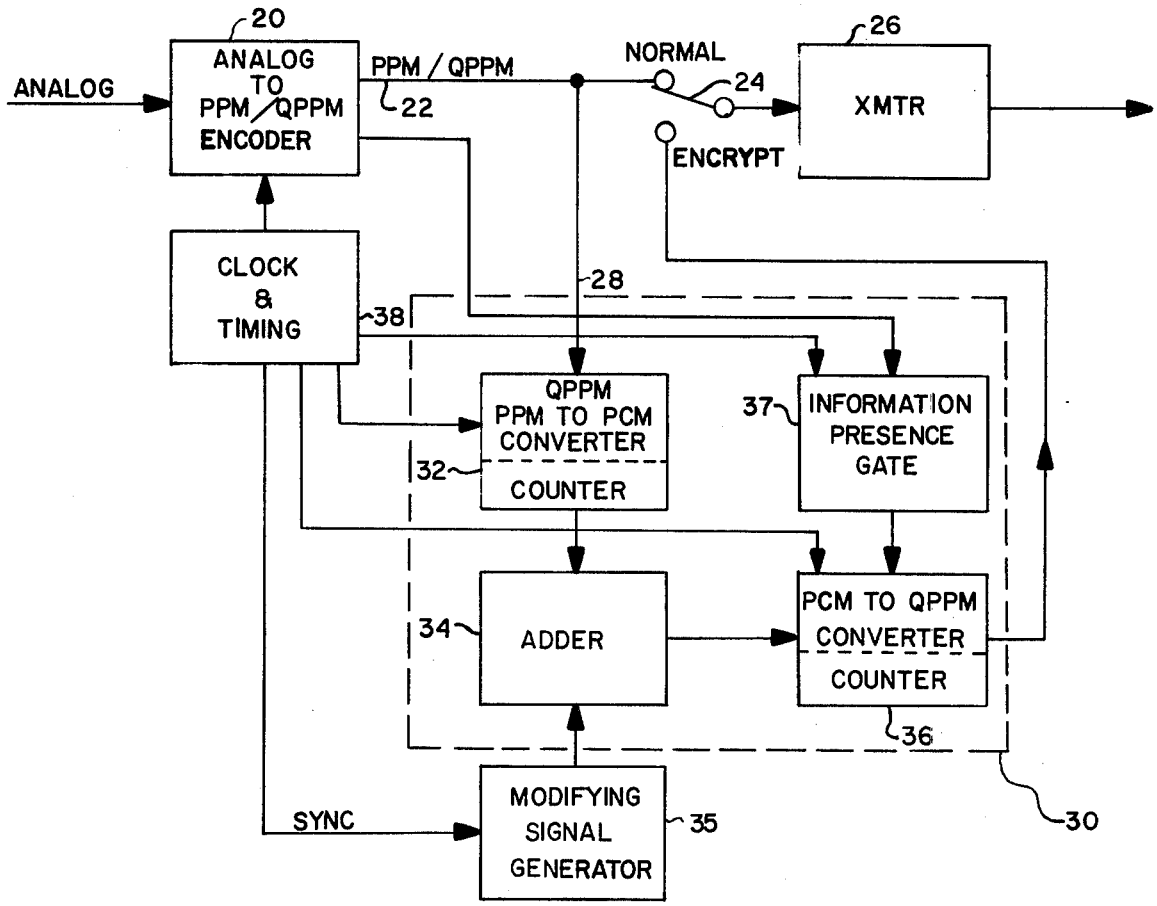
FIG. 2 is a functional diagram showing in more detail the arrangement by which the PPM intelligence is encrypted prior to transmission.

The more complete system shown in FIG. 2 may be considered as an analog-to-digital converter since the input shown is analog and the output is QPPM. An analog signal containing intelligence is applied to a PPM encoder 20 which performs the functions of sampling the analog signal amplitude and converting the amplitude samples to a PPM pulse train. As is well known, PPM defines a type of pulse modulation in which each pulse of a train of constant amplitude pulses is displaced with respect to a time reference in a sampling period in accordance with the sampled intelligence, i.e. amplitude sample. Consequently, the pulse positions in PPM are not discrete and each pulse may assume an infinite number of positions within the PPM period as determined by the sampled amplitude. The process of sampling an analog waveform and producing pulse signals representative of the amplitude of such sample will be referred to as "encoding" and the means for accomplishing this end an "encoder". The modifying of encoded amplitude samples to provide secrecy will hereinafter be referred to as "encryption" and the means for accomplishing this end an "encrypter".

Quantized pulse position modulation (QPPM) is a form of PPM in which the total displacement of the pulses is quantized so that pulses are permitted to appear only at discrete positions within the pulse sampling period. In the discussion to follow, for example, sixteen step or position QPPM is utilized. Sixteen quantizing levels may be represented by a four-bit binary code and may be controlled by a four-stage binary counter. However, it is to be understood that the inventive concept is not dependent upon the number of quantizing levels used.

PPM encoder 20 of FIG. 2 may be designed to produce either PPM signals or QPPM signals; however, for the purpose of discussion, PPM signals will be assumed. These signals are applied to an output line 22. When a switch 24 is in its NORMAL position as shown, the PPM pulse train is fed directly from encoder 20 through the switch to a suitable transmitter 26. However, when switch 24 is in the ENCRYPT position, the output of encrypter 30 feeds an encrypted QPPM pulse train to transmitter 26, since the output of encoder 20 now feeds its PPM pulse train to encrypter 30 via a conductor 28.

More specifically, the PPM pulses are applied to a converter 32 of FIG. 2 which quantizes the PPM pulses and converts them to PCM pulses. In case the incoming pulses are QPPM pulses, converter 32 similarly acts to convert the QPPM to PCM pulses. As described in more detail in FIG. 4*a*, the principal component of the converter is a binary counter which converts the position of each pulse in the PPM train to a binary-coded pulse group. At the end of each PPM period the output of the counter is fed to a binary adder 34. A modifying signal generator 35 feeds a binary-coded pulse group to adder 34 in accordance with this invention to modify the original PCM signal and produce an encoded encrypted PCM signal. This binary-coded pulse group may be from a random sequence key generator to which unauthorized persons would not have access. The purpose as will be developed at greater length hereinafter is to shift the pulses from their original position to new positions which are completely unpredictable to those not having access to the random sequence key generator. The encrypted PCM is then fed to a converter 36 which converts it to a corresponding sixteen position QPPM pulse train which is fed through switch 24 to the transmitter 26. Thus, the PCM converter technique herein described causes the position of the PPM pulses to be changed within the same modulation limits as those of the original PPM signal.

An INFORMATION PRESENCE GATE 37 may be controlled by encoder 20 or other means external to encrypter 30 for the purpose of inhibiting the operation of converter 36 to reduce the pulse density and to prevent a pure modifying signal from reaching transmitter 26. A clock and timing generator 38 provides the necessary clock pulses to operate the PPM encoder 20 and the timing pulses for operating encrypter 30.

Figure 3:
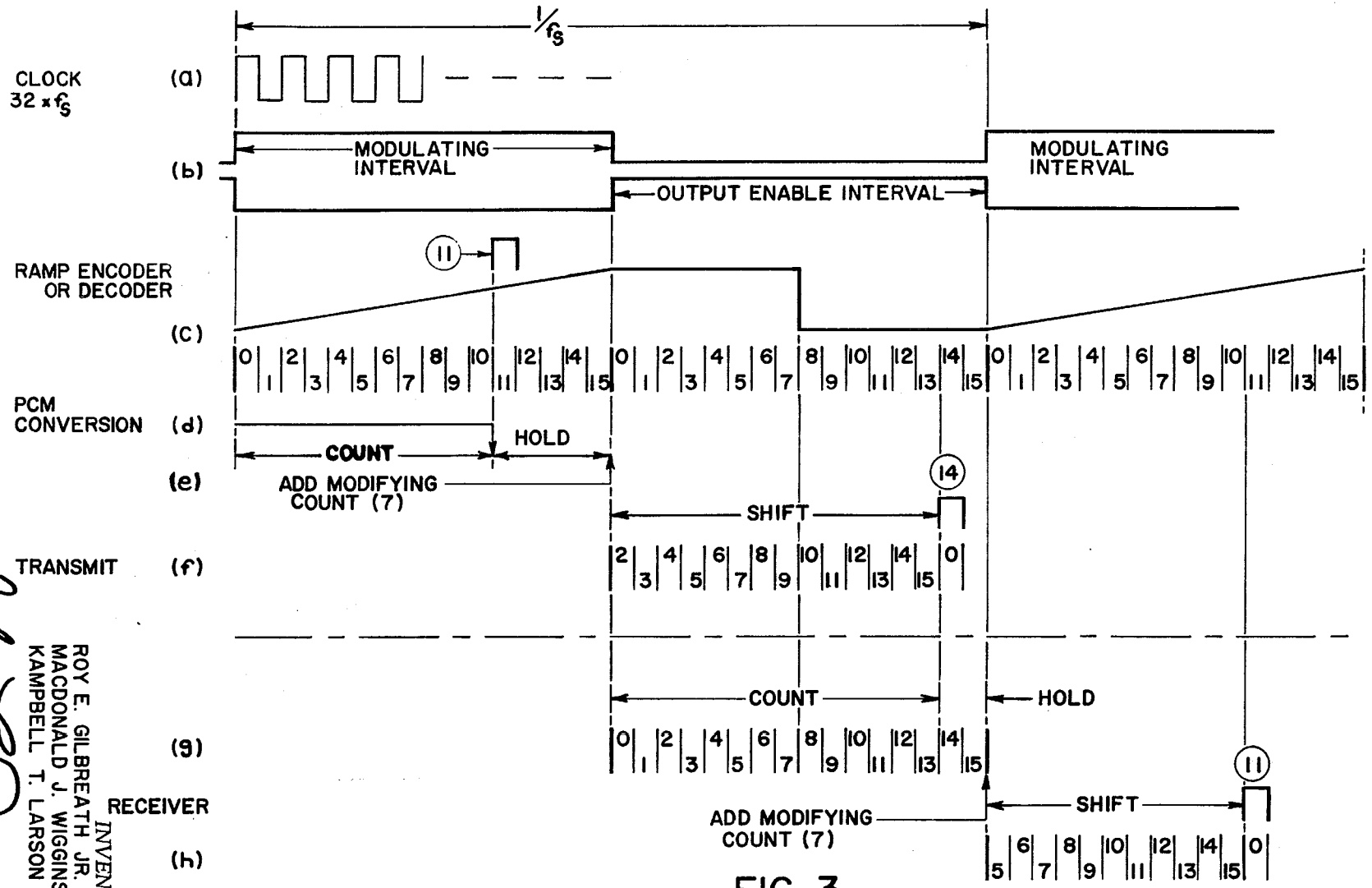
FIG. 3 is a timing diagram to be utilized in conjunction with the diagram of FIG. 2.

The timing diagram in FIG. 3 illustrates the manner in which the various pulse conversions take place utilizing the components illustrated in FIG. 1 and FIG. 2. For purposes of explanation, the several following assumptions relating to the encoder 20 and clock and timing 38 of FIG. 2 are made. However, it should be noted that the invention is not limited to these assumptions. Let it be assumed that the counters in converters 32 and 36 are four stage binary counters capable of storing any decimal number value from 0 to 15. Clock and timing generator 38 generates clock pulses at a rate which is a multiple of the sampling frequency utilized in PPM encoder 20 to convert the input analog signal to a PPM or QPPM pulse train. In the timing diagram, let us assume that the frequency of the clock pulses is thirty-two times the encoder sampling frequency $f_s$. This sampling rate is chosen to illustrate the use of sixteen quantizing steps and four-stage binary counters. The sampling period is then defined as $1/f_s$. The clock pulses are shown in line (a) of the timing diagram. The modulating interval utilized by encoder 20 is one-half of the sampling period and is indicated by the square wave in line (b) of the timing diagram. Encoder 20 may employ a conventional ramp voltage technique of converting the analog signal to a proportional pulse position within the modulating interval as shown in line (c). Line (d) of the timing diagram shows the manner in which the PPM is converted to PCM and modified thereafter to form an encrypted PCM signal.

The numbered vertical slots in line (c) represent the sixteen binary-coded bit positions of the binary counter in converter 32, and in a manner of speaking represent the quantization of the signal from the encoder. The counter is actuated by a clock pulse to start counting at the beginning of a modulating interval. In the example chosen, the sampled analog amplitude corresponds to pulse position 11 of one period of the PPM train which represents an information pulse in the position 11. Note the pulse above the ramp shown in line (c). The binary counter in counter 32 stops counting when the information pulse appears and stores the number 11 until the end of the modulating interval while the ramp voltage continues to the end of the modulating interval. This operation shown on line (d) is the conversion from PPM to PCM.

At this time, the modifying binary-coded signal from modifying signal generator 35 and the count "11" are added together in adder 34. The time for adding the modifying count is shown on line (e). For example, assume a modifying number of 7. Since the counter can count only up to fifteen, the modified count is "2". This is what is known as a modulo-16 adding operation. The modified count is then stored in the binary counter of converter 36 which is stepped or shifted with clock pulses until it resets to zero count. As shown in line (f) of the timing diagram, in this instance fourteen steps are required to reset this latter counter. When the counter resets, a pulse is emitted at the fourteenth quantized level or position, thereby producing an encrypted QPPM pulse, as seen in line (f) as 14. As will be apparent, the number 14 is the complement of 2 in a modulo-16 operation, so hence the count of 14 on line (f).

In the transmitted QPPM pulse train then, the intelligence which was originally represented by a pulse in position "11" of the PPM output of encoder 20 has been modified and is represented by a pulse in position "14" of the encrypted QPPM pulse train. The output of encrypter 30 is in the form of QPPM regardless of whether the output of PPM converter 20 is PPM or QPPM. Note that the encoded QPPM pulses have the same modulation limits as the original PPM at the output of converter 20, but the encoded output is displaced in time so that it occurs between the modulating intervals (line b) of converter 20 in an interval called the output enable interval.

The means by which the encoder QPPM is detected at a remote receiving station is illustrated by lines (g) and (h) of the timing diagram in FIG. 3. It will be noted that the timing lines (g) and (h) are in synchronism with timing lines (c) and (f), and the numbers in line (g) representing the receiver timing correspond with the numbers in line (c). The decrypting process is essentially the inverse of the encrypting procedure just described. Another four-bit binary counter counts clock pulses from the beginning of the output enable interval line (b) until the the transmitted QPPM pulse appears. In this case, the receiver binary counter similar to the transmitter counter 32 would count up to "14" and then stop counting and store this number. This operation is shown on line (g) and is the conversion from encrypted QPPM to encrypted PCM. At the end of the output enable interval the modifying number "7" would be added to the counter, as a result of the receiver modifying signal generator which is identical to and in synchronism with modifying signal generator 35 at the transmitter, in this case moving the counter position "5" as shown in line (h). The counter would then be stepped by the clock pulses of the receiver timing generator until the counter is reset to zero position. In this case, eleven clock pulses would be required for reset. The modified count of "5" commencing the count shown in line (h) actually represents the original intelligence in PPM form and the intelligence is recovered by stepping the counter to reset which requires eleven steps thereby indicating a pulse in position "11" of the PPM pulse train, which position corresponds to the original intelligence as shown in line (c) of the timing diagram.

The preceding discussion has explained the basic concepts of the invention and the methods or techniques for implementing these concepts. A preferred embodiment of an actual system embodying these concepts, techniques and methods is illustrated in FIGS. 4*a* and 4*b*. FIG. 4*a* shows the preferred encoding apparatus required at a transmitting station for transmitting the encoded QPPM signal, and FIG 4*b* shows the decrypting apparatus required at a receiving station for detecting the encoded QPPM and recovering the original intelligence therefrom. FIG. 4*a* employs a single counter 44 to perform the functions of PPM to PCM and PCM to QPPM conversions.

As shown in FIG. 4*a*, an analog signal, such as an amplitude varying telemetering signal or a voice signal, is applied to an analog-to-PPM/QPPM encoder 40, which itself is not part of this invention and performs the functions of sampling the amplitude of the analog input signal and converting it to a PPM form of modulation. As indicated in the figure, the output of encoder 40 may be either PPM or QPPM; however, let it be assumed that it is PPM where an information pulse may occur at any position within each time reference period as determined by the amplitude of the analog input signal. When switch 43 in line 47 is in its NORMAL position, the PPM pulse train passes via the switch to an output line 90 which may be coupled to a suitable transmitting device. However, for the purpose of the following discussion, switch 43 will be assumed to be in its ENCRYPT position.

A clock and timing pulse generator 42 generates the clock pulses and suitable timing pulses to control the operation of the system. A four-stage binary counter 44 serves the dual purpose of providing PPM-to-PCM conversion and PCM-to-QPPM conversion. For example counter 44 may consist of four bistable elements, such as flip flops, connected to perform a counting function.

At the start of the PPM modulating cycle of encoder 40, a modifying signal or code is set into counter 44 in order to obtain encryption. This of course differs from the embodiment described in conjunction with FIGS. 2 and 3 wherein the modifying count was added at the end of the modulating interval. In the example discussed in connection with FIGS. 2 and 3, this random modifying code was the binary-coded number "7". The modifying code in the FIG. 4*a* embodiment is provided by a modifying signal generator 45 whose four-bit binary output is connected in parallel to the inputs of an AND gate 46.

At the beginning of the cycle, the clock and timing generator 42 generates on line 48 a synchronizing pulse which commands modifying signal generator 45 to produce the modifying bits at the inputs of gate 46. Clock pulses produced on line 50 trigger a monostable multivibrator 52 which provides at the conditioning input 54 of gate 46 a gating pulse to permit the modifying bits from generator 45 to be passed through gate 46 and set into counter 44 at the beginning of each cycle.

Clock and timing generator 42 also provides on line 53 clock pulses to enable encoder 40 to sample and convert the input analog information to PPM. Generator 42 applies to line 54 a START pulse which passes through an OR gate 56 to set a bistable multivibrator 58, thereby conditioning an input 60 of a two-input AND GATE 62. The other input 64 of AND gate 62 carries clock pulses from the generator 42.

In the event it is desirable to use an Information Presence arrangement to eliminate some pulses representing zero information, a bistable multivibrator 72 may be employed to control the operation of output AND gate 76, discussed hereinafter. A set pulse for multivibrator 72 may be produced by encoder 40, which is delivered on line 71 to indicate the presence of a PPM information pulse, whereas a reset pulse may be fed via line 55 from clock 42 to place bistable multivibrator 72 in its reset (R) condition.

The PPM output of encoder 40 is applied to one input 66 of a two-input OR gate 68 whose output is connected to the reset input of bistable multivibrator 58. As is explained more fully below, when bistable multivibrator 58 is in its set (S) condition, line 60 is energized to pass clock pulses through AND gate 62 to counter 44 which will count clock pulses until a PPM pulse appears at input 66 of OR gate 68. This completes the conversion from PPM to encrypted PCM inasmuch as the modifying count had previously been placed in counter 44. This PPM information pulse will appear at the output of OR gate 68 to reset bistable multivibrator 58 and decondition line 60, thereby closing AND gate 62 for this modulating interval. Counter 44 will then store its count until the end of this interval. As explained in more detail below, timing generator 42 then applies an END pulse to a line 63, which pulse passes through OR gate 56 to return multivibrator 58 to its (S) condition in preparation for the conversion of encrypted PCM to encrypted QPPM.

The encoder 40 is arranged, as previously mentioned, to produce a pulse on line 71 to place bistable multivibrator 72 in a set (S) condition thereby indicating the presence of the PPM pulse. Consequently, output line 74 from BSMV 72 will be energized to condition one of the inputs of a three-input AND gate 76. Another input to this gate is a line 78 which is connected to the output of a monostable multivibrator 80 driven by the output of binary counter 44. Line 78 actually carries the encrypted QPPM pulses since monostable multivibrator 80 is triggered each time binary counter 44 is reset during the conversion of the modified or encrypted PCM to QPPM. The third input to output AND gate 76 is connected to a line 82 which is carrying an output enable signal from generator 42.

Consequently, a QPPM output pulse will appear in one of sixteen discrete time positions on the output line 84 of AND gate 76 when multivibrator 80 is triggered during the second half of the PPM period ($1/f_s$). As will be recalled for the case illustrated in the timing diagram of FIG. 3, thirty-two clock pulses occur within each PPM cycle or period and, therefore, a QPPM pulse can occur at the output of AND gate 76 only at one of sixteen discrete positions within the second half or output enable interval of each period of the original PPM. The QPPM pulse appearing on line 78 passes through AND gate 87 conditioned by line 82 and is connected by a line 86 through OR gate 68, to reset bistable multivibrator 58 and close gate 62 so that no more clock pulses are counted during that output enable interval by counter 44.

The complete operation of the encrypter shown in FIG. 4*a* will now be described. Timing pulses are applied by generator 42 to encoder 40 via line 53. Generator 42 also applies clock pulses on line 50 to trigger monostable multivibrator 52 and condition AND gate 46 to pass to counter 44 the modifying signal in the form of binary bits, when modifying signal generator 45 is actuated by a suitably timed sync pulse from timing generator 42 on line 48. In the example illustrated in the timing diagram of FIG. 3, these binary bits represent the modifying number "7".

At the beginning of the encoding cycle, a START pulse is produced by generator 42 on line 54 and applied to an input of OR gate 56 whose output sets bistable multivibrator 58, thereby applying a conditioning pulse to input 60 of AND gate 62, whose other input 64 carries clock pulses from generator 42. Consequently, binary counter 44 counts such clock pulses until an incoming PPM pulse from the analog to PPM encoder 40 appears on the output line 41. This PPM pulse is applied to one input 66 of OR gate 68 to reset multivibrator 58 and decondition or close AND gate 62. Counter 44 then ceases counting and stores in binary form the number of clock pulses counted. This binary coded number in the counter represents the conversion of the PPM signal on line 41 to a modified or encrypted PCM signal since counter 44 stores the sum of the modifying binary code signal from generator 45 plus the number of clock pulses counted by counter 44 before the arrival of the PPM pulse.

In order to convert the encoded PCM to QPPM, clock and timing generator 42 produces on line 83 an END timing pulse which is applied to the other input of OR gate 56 once again to set multivibrator 58 and condition or open AND gate 62 so that binary counter 44 resumes counting of clock pulses. The END pulse will be generated at the end of the modulating interval in line (b) of FIG. 3 or, in other words, at the midpoint of the PPM period. The effect of these clock pulses is to step or shift counter 44 until it resets to a zero count. At the time counter 44 resets, an output pulse is produced on its output line 49 to trigger monostable multivibrator 80 to produce a shaped pulse on line 78. The output enable signal from the clock appearing on line 82 gates the pulse through gate 76 to produce on line 84 a QPPM pulse which passes through switch 43 to the encoder output line 90 for transmission.

The QPPM pulse on line 78 is also fed through AND gate 87 during the Output Enable Interval by virtue of the conditioning of this gate by a signal from clock 42 on line 86. This pulse passing through the other input of OR gate 68 resets bistable multivibrator 58, thereby opening AND gate 62 to prevent the binary counter from counting additional clock pulses and maintain it at zero count. In the beginning of the next PPM period the encrypting cycle is repeated.

Although this invention has been set forth with primary emphasis on an encryption technique, it nevertheless is broad enough to comprehend use in conjunction with other types of information transfer systems, such as telemetering systems, computer data transfer operations, and the like. In such instances, the modifying signal generator would provide conditioning functions other than encryption, such as scale factoring, linearizing, and the like. The conditioning functions may be applied in the transmitter or in the receiver or in both as may be required.

FIG. 4*b* shows the decoder apparatus which will be located at an authorized receiver for decoding the transmitted encoded QPPM. The operation of this apparatus is basically the inverse of that shown in FIG. 4*a*.

The QPPM signal is received and applied through a switch 100 to one input 101 of an OR gate 102 whose output is connected to the reset (R) terminal of a bistable multivibrator 104. A clock and timing generator 106 is synchronized with the encoder timing generator 42 of FIG. 4*a* and provides suitable timing and synchronizing pulses to a monostable multivibrator 108 and a modifying signal generator 110 to gate the modifying signal in parallel through an AND gate 112 to a four-stage binary counter 114 prior to the beginning of the decoding cycle. At the start of the decoding cycle, generator 106 generates a START pulse which is applied through one input of an OR gate 116 to set bistable multivibrator 104 and open an AND gate 118 which passes clock pulses from generator 106 to binary counter 114. When a QPPM pulse is received within the PPM modulating interval, it passes through OR gate 102 to reset multivibrator 104 to close AND gate 118 and stop the operation of counter 114. Counter 114 now stores the same binary count or encoded PCM signal which was produced by the counter 44 in the encoder of FIG. 4*a*.

Also, at the time of the occurrence of a QPPM pulse at the input of the decoder, a bistable multivibrator 120 was set to indicate the presence of an information pulse. When bistable multivibrator 120 is in its set (S) condition, a signal appears on its output line 122 thereby enabling one input of a three-input AND gate 124. Another input 126 is energized by the output enable signal generated by clock and timing generator 106. The third input is derived from a monostable multivibrator 128 which is connected to the output of binary counter 114.

At the end of each PPM modulating interval an END pulse is generated by generator 106 and applied through OR gate 116 to again set multivibrator 104 so that gate 118 is open to pass clock pulses to counter 114. When the counter is stepped to its reset or zero potion, an output pulse is applied to monostable multivibrator 128 to produce a QPPM pulse which is passed through AND gate 124 during output enable interval and fed via a line 130 and switch 100 to a PPM-to-analog converter 134 which reproduces the analog or amplitude modulated signal which was the original input signal to converter 40 in FIG. 4*a*. The PPM pulse from AND gate 133 is applied to the other input 132 of OR gate 102 to return bistable multivibrator 104 to its reset position to await the occurrence of another START pulse from generator 106 at the beginning of the next decoding cycle.

The apparatus illustrated in FIGS. 4*a* and 4*b* is considered to be operating in the parallel mode. That is, the modifying signal is fed parallel-by-bit to counters 44 and 114 and a parallel mode of addition occurs in the counters. This same basic mode of operation may be utilized with slight variations. For example, after the modifying signal is set in counter 44, the system can be arranged so that the counter does not start counting clock pulses until an information pulse is received on line 41 rather than having the counter start counting clock pulses from the beginning of the encoding cycle until the occurrence of an information pulse. With such an arrangement, counter 44 would then count clock pulses from the occurrence of each information pulse to the end of the modulating interval and then continue without stopping to shift out the stored count by stepping the counter to reset or zero count to produce a QPPM pulse. In such an arrangement, the information presence gate is not necessary because the entire operation of the converter is contingent upon receiving an information pulse. Consequently, if no information pulse occurs, there is no output from the converter. The decoder for such a modified arrangement would be arranged so that the modifying code count is subtracted from the stored PCM count derived from each incoming QPPM pulse. The modified PCM would then be converted to PPM by beginning to shift out the modified count with the clock pulse which occurs immediately after receipt of an information pulse. When the counter resets to zero, an output PPM pulse would then be generated and fed to a PPM-to-analog converter 134 and also to the reset input of the counter control bistable multivibrator 104.

FIG. 5 shows another modified form of an encoder operating in parallel mode and uses a modulo-2 adder. A clock and timing pulse generator 150 supplies clock pulses to an analog-to-PPM encoder 152 which produces PPM or QPPM pulses on line 154. Generator 150 also produces a START pulse which is applied via a line 158 to reset a bistable multivibrator 160. The START pulse is also fed via a line 162 to the set (S) input of a bistable multivibrator 168 whose set output terminal is connected to an input 170 of a two-input AND gate 172. The other input 174 is supplied with clock pulses from generator 150 via line 176. Consequently, clock pulses are counted by a four-stage binary counter 178. An information pulse appearing at the output of encoder 152 is applied via a line 180 to reset multivibrator 168, thereby closing gate 172 and stopping the counting action of counter 178 which then stores its count until the end of the modulating interval as shown in FIG. 3. The stored count is the PCM equivalent of the original PPM.

A control signal from encoder 152 on line 156 returns multivibrator 160 to its set (S) condition. Consequently, the set output of multivibrator 160 is energized to condition one input 182 of a two-input AND gate 184. At the end of the modulating interval, generator 150 applies an END pulse to the other input 186 of AND gate 184. Consequently, the END pulse is passed through AND gate 184 to set another bistable multivibrator 188, and the pulse is also applied via a line 185 to trigger a monostable multivibrator 187 whose output is applied via a line 189 to open an AND gate 191 which is connected to the parallel binary-coded output of counter 178. The stored PCM count in counter 178 is fed in parallel to a modulo-2 parallel adder 199. The output of multivibrator 187 is also applied via a line 193 to open an AND gate 195 to permit the modifying binary-coded signal from a modifying signal generator 197 to be fed in parallel to adder 199. The sum of the stored PCM count and the modifying signal from generator 197 is the modified or encoded PCM count which is fed in parallel to another four-stage binary counter 196. Output gate 202 is inhibited via line 204 during the transfer operation.

The set output of multivibrator 188 is applied to one input 190 of a two-input AND gate 192. The other input is supplied with clock pulses via line 194. These clock pulses are then fed to counter 196 which is stepped by the clock pulses until it resets, at which time a pulse is produced on line 198. This pulse occurs in one of the sixteen quantized positions and triggers a monostable multivibrator 200 whose output pulse is a QPPM pulse corresponding to the modified or encoded PCM. The QPPM pulse will go through AND gate 202.

The QPPM pulse of the output of AND gate 202 is then passed through ENCRYPT-NORMAL switch 206 to a suitable transmitter. The QPPM pulse is also fed back via a line 208 to reset both binary counter 178 and bistable multivibrator 188. The encoder is now in condition to begin the next cycle when another START pulse is generated by timing pulse generator 150.

Since a serial binary adder is less complex than a parallel binary adder, it may be desirable to convert the PCM signal to serial form and feed the resulting pulses in series to a serial binary adder with or without carry. Then, the modifying signal would also be in serial binary form, and the modifying bits would be fed in series to the serial adder. FIGS. 6, 7 and 8 show modifications of the preferred embodiment of FIG. 4*a* wherein a serial adder is used.

For example, in FIG. 6 a binary counter 220 is arranged also to be operated as a shift register. Without going into all of the details of the block diagram shown, a START COUNT pulse is generated by suitable clock pulse and timing pulse generating circuits and applied via a line 222 to one input of AND gate 224 and also resets BSMV 228 via line 250. The other input 226 is energized if BSMV 228 is set (S). A bistable multivibrator 230 is then set to provide a COUNT control pulse to binary counter 220 and also to condition an AND gate 232 which permits clock pulses (CP) to be counted by counter 220. When a PPM/QPPM information pulse appears, BSMV 230 is reset, thereby closing AND gate 232 and stopping operation of counter 220.

After the counting is completed, the clock and timing circuits generate a START PCM SHIFT signal which sets a bistable multivibrator 234 which provides a SHIFT control signal to counter 220 to convert its operation to shift register operation. This SHIFT signal also conditions an AND gate 236 to pass clock pulses which function as shifting pulses for the shift register mode of operation of counter 220. The count is then serially shifted out of counter 220 to the serial binary adder 238. These shift pulses also step a modifying signal generator 240 which provides a series binary code signal which is added in adder 238 to the output of counter 220. The same shifting pulses step a two-stage binary counter 244 which will count four clock pulses in binary fashion and then reset. The four binary outputs of counter and matrix 244 act as timing pulses t1, t2, t3 and t4 to condition sequentially four AND gates 242 each of which is connected to a different stage of a four-stage binary counter 245. The serial output of adder 238 is thereby set in counter 245 in parallel mode PCM. When counter 244 resets to zero after counter 245 is set, it generates a START QPPM SHIFT pulse which sets another bistable multivibrator 246 to condition an AND gate 248 which passes clock pulses to counter 245 until it resets to zero thereby stepping or shifting out the stored count to provide a QPPM pulse. The QPPM pulse is passed through a shaper and then fed to a transmitter. It is also fed back to reset BSMV 246.

Another arrangement for utilizing a serial adder is shown in FIG. 7. Here, the parallel four-bit output from binary counter 178 in FIG. 5 has each bit connected to one input of a corresponding one of four AND gates 260. The AND gates are read out sequentially by a two-stage binary counter 262 whose four output terminals are each connected to the other input of a corresponding one of AND gates 260. As counter 262 is stepped by clock pulses, the count stored in counter 178 is fed serially to a serial adder such as 238 in FIG. 6 to which the modifying signal is also applied in series form. The serial output of the adder is then reconverted to parallel code by applying the output of the adder to the four AND gates 242 (FIG. 6) which are connected to corresponding stages of the four-stage binary counter 245, and which are gated sequentially by the two-stage counter output timing pulses t1, t2, t3 and t4. This arrangement prevents the necessity for changing the four-stage binary counter 178 to a shift register as illustrated in FIG. 6.

Still another arrangement for utilizing a serial adder is shown in FIG. 8. Here, the PCM signal output from four-stage binary counter 270 is gated out in parallel through AND gate 272 and set in a shift register 274. The stored PCM count in the shift register is then shifted out in serial form through a serial adder 276 to which a serial modifying count signal is fed. The modified PCM signal is then fed in serial form to a serial-to-parallel mode converter 278 from which it is gated in parallel and set back into counter 270. Counter 270 is then shifted or stepped to a reset condition to produce the desired QPPM pulse.

Preferred embodiments of this invention, together with modifications thereof, have been described above. It is recognized that other modifications will become apparent to persons skilled in the art to which this invention appertains. Such modifications are also considered to be part of this invention whose scope is intended to be limited only as defined in the appended claims.

We claim:

1. A method of encrypting a PPM intelligence signal comprising:

(a) converting the PPM signal to an encrypted PCM signal, and (b) converting said encrypted PCM signal to a corresponding PPM signal.

2. A method of encrypting a PPM intelligence signal comprising:

(a) converting the PPM signal to an encrypted PCM signal, and (b) converting said encrypted PCM signal to a corresponding quantized PPM signal.

3. A method of encrypting an intelligence signal comprising:

(a) converting the intelligence signal to a first PPM signal, (b) converting said first PPM signal to an encrypted PCM signal, and (c) converting said encrypted PCM signal to a second PPM signal.

4. A method of encrypting a signal whose amplitude is modulated by intelligence comprising:

(a) converting the amplitude modulated signal to a first quantized PPM signal, (b) converting said quantized PPM signal to an encrypted PCM signal, and (c) converting said encrypted PCM signal to a second quantized PPM signal.

5. A method of encrypting an analog intelligence signal comprising:

(a) converting said analog intelligence signal to a first PPM intelligence signal, (b) converting said PPM intelligence signal to a PCM signal, (c) modifying said PCM signal according to a code, (d) converting the modified PCM signal to a second PPM signal, and (e) transmitting said second PPM signal.

6. A method of encrypting an analog intelligence signal as defined in claim 5 wherein said second PPM signal is a quantized PPM signal.

7. A method of transmitting intelligence as an encrypted signal in pulse position modulated form comprising:

(a) converting said intelligence to a PPM intelligence signal, (b) converting said PPM intelligence signal to a binary-coded PCM signal, (c) adding a predetermined binary number to said PCM signal to produce a modified binary-coded PCM signal, (d) converting said modified PCM signal to a quantized PPM signal, and (e) Transmitting said quantized PPM signal.

8. Apparatus for converting a PPM signal to an encrypted quantized PPM signal comprising:

(a) means for converting a PPM signal to a PCM signal, (b) means coupled to said converting means for modifying the PCM signal to produce an encrypted PCM signal, and (c) means connected to said modifying means for converting said encrypted PCM to a corresponding quantized PPM signal.

9. Apparatus for converting a PPM signal to an encrypted quantized PPM signal comprising:

(a) means for converting a PPM signal to a binary-coded PCM signal, (b) binary adder means connected to the output of said converting means, (c) means feeding a predetermined binary number signal to said adder to modify said PCM signal, and (d) means connected to the output of said adder to convert the modified PCM signal to a corresponding encrypted quantized PPM signal.

10. Apparatus for converting a PPM intelligence signal to an encrypted quantized PPM signal comprising:

(a) a binary pulse counter means, (b) means for stepping said counter means in accordance with a PPM intelligence signal to thereby store in said counter means for each period of the PPM signal a PCM signal in the form of a binary-coded bit count, (c) means for adding a modifying number to the stored bit count to produce a modified bit count, and (d) means for serially shifting out of said counter means the bits representing the modified count, to produce a quantized PPM signal which is an encrypted form of said PPM intelligence signal.

11. Apparatus for converting a PPM intelligence signal to an encrypted quantized PPM signal comprising:

(a) binary counter means,
(b) means for stepping said counter means in accordance with a PPM intelligence signal to thereby store in said counter means for each period of the PPM signal a PCM signal in the form of a binary-coded bit count,
(c) means for applying modifying bits,
(d) binary adder means coupled to said first binary counter and to said applying means to produce a modified bit count representing a modified PCM signal,
(e) means for storing said modified count in said counter means, and
(f) means for serially shifting out the modified count bits from said counter means to produce a quantized PPM signal which is an encrypted form of said PPM intelligence signal.

12. Apparatus for converting a PPM intelligence signal to an encrypted quantized PPM signal as defined in claim 11 wherein said adder means is a serial adder and further comprising a shift register coupled between said binary counter means and said adder means for storing the PCM signal bit count of said counter means, and means for operating said shift register to read out serial-by-bit the count stored therein.

13. Apparatus for converting a PPM intelligence signal to an encrypted quantized PPM signal as defined in claim 11 wherein said counter means comprises a first binary counter which is stepped in accordance with said PPM intelligence signal and a second binary counter in which said modified count is stored.

14. Apparatus for converting a PPM intelligence signal to an encrypted quantized PPM signal as defined in claim 13 wherein said adder is a parallel-by-bit adder and further comprising means to feed parallel-by-bit the stored count bits in said first counter and said modifying bits to said adder, and means to feed the modified count bits from said adder in parallel to said second binary counter.

15. Apparatus for converting a PPM intelligence signal to an encrypted quantized PPM signal as defined in claim 13 wherein said adder is a serial-by-bit adder and further comprising means to read out in series the stored count in said first counter and feed it serial-by-bit to said adder, means to feed said modifying count serial-by-bit to said adder, said adder producing said modified bit count in serial-by-bit form, and means coupled between said adder and said second binary counter for converting said modified bit count to parallel-by-bit form.

16. Decrypting apparatus for decrypting an encrypted quantized PPM signal which is derived from an original PPM intelligence signal comprising:
(a) means for converting the quantized PPM signal to a corresponding binary-coded PCM signal,
(b) means for modifying said PCM signal with a predetermined binary-coded modifying signal to produce a decrypted PCM signal, and
(c) means for converting said PCM signal to said original PPM intelligence signal.

17. A secret communication system for sending intelligence between a transmitter and a receiver comprising, means for converting the intelligence to a first PPM signal, means for converting said first PPM signal to a first PCM signal, means to modify said PCM signal with a secret signal to produce an encrypted first PCM signal, means for converting said encrypted PCM signal to a corresponding quantized PPM signal, means for transmitting said quantized PPM signal, means for receiving said quantized PPM signal, means for converting said quantized PPM signal to a second encrypted PCM signal, means to modify said second encrypted PCM signal with said secret signal to produce a decrypted second PCM signal, means to convert said decrypted PCM signal to a corresponding second PPM signal, and means to derive the intelligence from said second PPM signal.

18. An information transfer system for sending intelligence between a transmitter and a receiver comprising, means for converting the intelligence to a first PPM signal, means for converting said first PPM signal to a first PCM signal, means to modify said PCM signal with a conditioning signal to produce a conditioned first PCM signal, means for converting said conditioned PCM signal to a corresponding quantized PPM signal, means for transmitting said quantized PPM signal, means for receiving said quantized PPM signal, means for converting said quantized PPM signal to a second conditioned PCM signal, means to modify said second conditioned PCM signal with modifying signal to produce a conditioned third PCM signal if required, means to convert said conditioned PCM signal to a corresponding second PPM signal, and means to derive the intelligence from said second PPM signal.

* * * * *